US005312311A

United States Patent [19]

Pearson

[11] Patent Number: 5,312,311

[45] Date of Patent: May 17, 1994

[54] EXERCISE BICYCLE

[76] Inventor: William G. Pearson, 207 S. Franklin St., Box 513, Cochranton, Pa. 16314

[21] Appl. No.: 956,383

[22] Filed: Oct. 5, 1992

[51] Int. Cl.[5] ..... A63B 23/04

[52] U.S. Cl. ..... 482/57; 482/908; 601/36

[58] Field of Search ..... 482/57, 908, 63; 128/25 R

[56] References Cited

U.S. PATENT DOCUMENTS

| | | | |
|---|---|---|---|
| 3,750,479 | 8/1973 | Gause et al. | 482/57 |
| 3,806,194 | 4/1974 | Kolebaba | 297/347 |
| 4,039,091 | 8/1977 | Adamski et al. | 214/77 |
| 4,185,335 | 1/1980 | Alvis | 4/251 |
| 4,283,803 | 8/1981 | Krumbeck | 4/496 |
| 4,441,218 | 4/1984 | Trybom | 4/252 |
| 4,448,437 | 5/1984 | Montague | 280/287 |
| 4,524,988 | 6/1985 | Netznik | 280/208 |
| 4,550,908 | 11/1985 | Dixon | 272/130 |
| 4,583,251 | 4/1986 | Karl et al. | 4/555 |
| 4,673,178 | 6/1987 | Dwight | 482/57 |
| 4,726,081 | 2/1988 | Duffin et al. | 4/564 |
| 4,728,119 | 3/1988 | Sigafoo | 280/657 |
| 4,949,954 | 8/1990 | Hix | 272/73 |
| 5,027,446 | 7/1991 | Robertson | 4/254 |
| 5,027,794 | 7/1991 | Pyle | 128/25 R |
| 5,033,736 | 7/1991 | Hirschfeld | 482/57 |
| 5,035,418 | 7/1991 | Harabayashi | 482/57 |
| 5,163,451 | 11/1992 | Grellas | 128/25 R |
| 5,209,223 | 5/1993 | McGorry et al. | 128/25 R |

*Primary Examiner*—Stephen R. Crow

*Attorney, Agent, or Firm*—Charles L. Lovercheck; Wayne L. Lovercheck

[57] ABSTRACT

The bicycle of the present invention has a seat having a high padded back, padded arm rests, is rotatable through three hundred and sixty degrees and has a lock to hold it in adjusted positions. The seat can be lowered by a hydraulic cylindrical, electric motor or the like for easy mounting and dismounting. The seat can be raised to a convenient use position and has seat belt, shoulder straps made of a VELCRO-type material. The pedals have slide-in foot supports and support straps which are made of a VELCRO-type material.

2 Claims, 2 Drawing Sheets

EXERCISE BICYCLE

BACKGROUND OF THE INVENTION

This invention relates to exercise equipment and more particularly to exercise bicycles. Some invalids and handicapped persons find it difficult to mount and dismount exercise bicycles. When the seat is in an elevated position for efficient use, the seat is far too high for many invalids or handicapped persons to conveniently mount.

Applicant is aware of the following U.S. Pat. Nos.:

3,806,194 to Kolebaba for Elevating Chat for Handicapped People.

4,283,803 to Krumbeck for Process for Immersing in a Swimming Pool Disabled Persons Using a Wheelchair.

4,039,091 to Adamski et al. for Elevator Type Bus Boarder.

4,185,335 to Alvis for Movable Toilet Seat Assembly.

4,441,218 to Trybom for Position Adjusting Device for Sanitary and Plumbing Units Using Water Under Pressure.

4,448,437 to Montague for Foldable Bicycle.

4,524,988 to Netznik for Upright Bicycle for Handicapped.

4,550,908 to Dixon for Physical-Rehabilitation and Exercising Apparatus.

4,583,251 to Furst Karl et al. for Seat Bath Unit.

4,726,081 to Duffin et al. for Bath With a Vertically Movable Seat.

4,728,119 to Sigafoo for Travel Chair for the Elderly and Physically Handicapped.

4,949,954 to Hix for Jointed Bicycle-simulation Device for Isometric Exercise.

5,027,446 to Robertson for Toilet Seat Lift Device.

None of the above prior art shows an exercise bicycle with vertically adjustable power actuated and padded seat, backrest, padded arm rests, slide-in foot pedals with VELCRO-type material, VELCRO-type material seat belt and shoulder harness.

SUMMARY OF THE INVENTION

The present invention provides an adjustment for bicycle seats whereby the seat can be lowered to a convenient height to enable the patient to conveniently mount and dismount the bicycle. When the invalid is comfortably seated, the seat may then be raised to a convenient height f or exercise. The bicycle has a fully rotating lockable padded seat, arm rests, a VELCRO-type material seat belt, shoulder harness and guard pedals. A motor drives the bicycle wheel to exercise the legs of patients who are paralyzed or cannot pedal the bicycle themselves.

It is an object of the present invention to provide an exercise bicycle that has an adjustable seat.

It is another object of the invention is to provide a bicycle with a vertically adjustable high padded rotatable, lockable seat and padded arm rests.

It is another object of the present invention to provide an exercise bicycle that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 2:
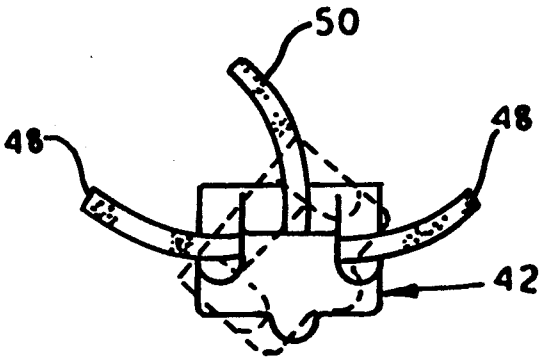
FIG. 2 is a detailed view of the connection between the seat belt and the shoulder strap.
Figure 3:
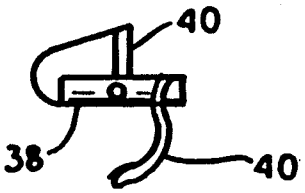
FIG. 3 is a detailed side view of a pedal and pedal guard strap.
Figure 1:
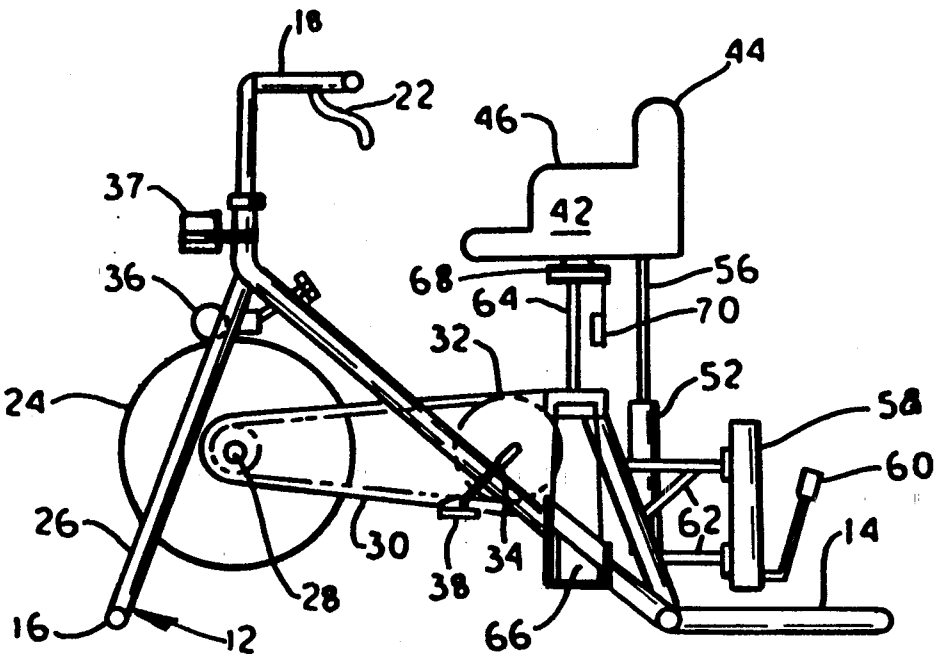
FIG. 1 is a side view of the invalid exercise bicycle according to the invention.
Figure 5:
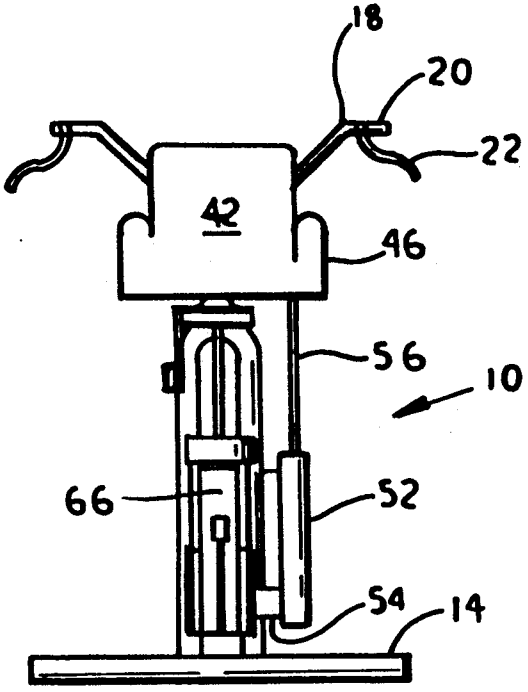
FIG. 5 is a rear view of the exercise bicycle according to the invention.
Figure 4:
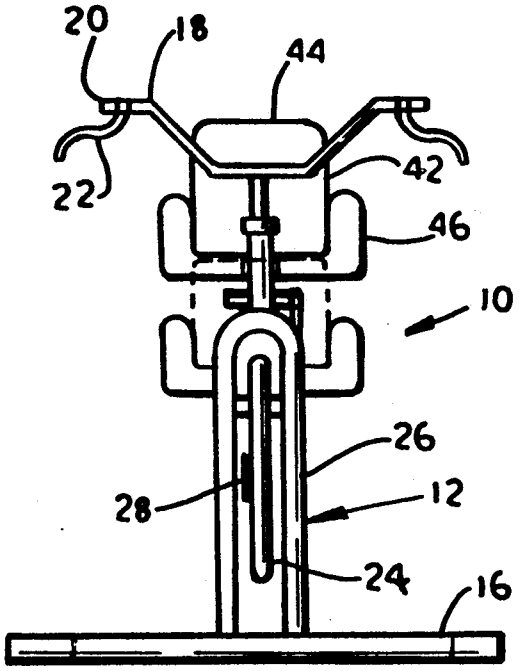
FIG. 4 is a front view of the exercise bicycle according to the invention.

Now with more particular reference to the drawings, an exercise bicycle 10 for the handicapped is shown. Exercise bicycle 10 has frame 12 attached to rear support 14 and front support 16. Handle bars 18, supported on frame 12, have handle grips 20 with safety straps 22 made of a VELCRO-type material attached thereto to surround the had of the patient. Rear support 14 and front support 16 may rest on the floor or any other supporting surface.

Front wheel 24 is rotatably supported on fork 26 by front axle 28 and driven by chain 30 through sprocket 32 and crank 34. Motor 36 adjusts the load exerted in pedals 38 by the patient. Motor 36 is of a type familiar to those skilled in the art of exercise bicycles. Motor 36 may be driven by a battery or by a power line. Height gage 37 indicates the height of the seat and may be electrically, hydraulically or mechanically controlled, supported on fork 26 and connected to hydraulic cylinder 52. Pedals 38 are equipped with slide-in foot brackets and safety straps 40 which may be made of a VELCRO-type material to hold the feet of the patient in place on pedals 38 and the hands of the patient in place on handles 60.

Seat 42 is a large padded seat, similar to that found in overstuffed furniture, with high back rest 44 and arm rests 46. Seat 42 is equipped seat belt 48 and shoulder strap 50, which may be made of a VELCRO-type material for safety and comfort in supporting a weak patient while exercise bicycle 10 is in use.

Seat 42 may be raised and lowered to adjust to a convenient position for a patient to mount and dismount by means of hydraulic cylinder 52 which is attached at lower end 54 to frame 12 and has piston 55 and piston rod 56 connected to seat 42. Pump 58 with handle 60 supplies fluid under pressure to hydraulic cylinder 52 through pipes 62. Seat 42 is supported on column 64 which is guided up and down by seat guide 66. Seat 42 can be rotated three hundred and sixty degrees and is held in position by seat locking mechanism 68 with lock control handle 70. As an alternative, seat 42 may be raised and lowered by means of an electric motor and gear box.

In use, the patient will first lower seat 42 to a convenient position to sit on. The patient will then lift seat 42 to a convenient height to operate pedals 38. The patient will then lock seat 42 in position by means of seat locking mechanism 68. The patient can then rest his feet on pedals 38 and foot straps 40 may then be fastened. The patient can then pedal the bicycle in an ordinary manner, or drive pedals 38 with motor 36 to increase the patient's legs. When finished, the patient can lower his feet from pedals 38, unlock seat 42 and rotate him or herself to a convenient dismounting position, unfasten seat belt 48 and shoulder strap 50 and lower seat 42 to a convenient position for dismounting. The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An exercise bicycle having a frame;

said frame having a seat, handle bars, foot pedals, motor means, a height gage, and a front wheel supported on said frame;

said front wheel being connected to said foot pedals and said motor means being connected to said front wheel for driving said front wheel;

adjustable support means comprising a hydraulic cylinder being adapted to support said seat on said frame;

power means including a hydraulic pump connected to said hydraulic cylinder for up and down adjustment of each said seat between a. convenient mounting position and to a convenient dismounting position;

said height gage being adapted to indicate the height of said seat relative to said frame;

a manually actuated means on said hydraulic pump;

said seat being adapted to rotate one hundred and eighty degrees on said adjustable support means;

lock means on said seat to lock said seat in a predetermined position of rotation;

a VELCRO-type material seat belt and a VELCRO-type material shoulder strap supported on said seat for safety and comfort of the user; and, said foot pedals have slide-in type foot brackets made of VELCRO-type material adapted to hold the user's feet in said foot brackets to prevent accidental removal of said user's feet;

2. An exercise bicycle having a frame, a motor, a front wheel, handle bars, pedals and a seat all supported on said frame;

a hydraulic cylinder connected to said seat having adjusting means adapted to move said sat to selected positions for convenience in use in mounting and in dismounting;

said seat being rotatable through three hundred and sixty degrees; and, a locking means on said seat to lock said seat in selected positions;

said motor being connected to said front wheel for driving said pedals to exercise an invalid's legs;

said seat being of a large padded seat having a high back rest and padded arm rests for comfort and safety;

said seat having a shoulder strap comprising VELCRO-type material;

slide-in foot supports made of VELCRO-type material safety straps on said pedals; and, said handle bars having hand grip straps made of said VELCRO-type material.

* * * * *